US012221961B2

(12) United States Patent
Becker et al.

(10) Patent No.: US 12,221,961 B2
(45) Date of Patent: Feb. 11, 2025

(54) VACUUM PUMP WITH MOVABLE TRAPEZOIDAL SEAL

(71) Applicant: Pfeiffer Vacuum Technology AG, Asslar (DE)

(72) Inventors: Jonas Becker, Bischoffen (DE); Jan Hofmann, Gruenberg (DE); Sebastian Latta, Wetzlar (DE); Heiko Schaefer, Solms-Niederbiel (DE); Maik Schaefer, Weinbach (DE); Wolfgang Soehngen, Waldsolms (DE)

(73) Assignee: Pfeiffer Vacuum Technology AG, Asslar (DE)

( * ) Notice: Subject to any disclaimer, the term of this patent is extended or adjusted under 35 U.S.C. 154(b) by 0 days.

(21) Appl. No.: 18/545,789

(22) Filed: Dec. 19, 2023

(65) Prior Publication Data

US 2024/0209855 A1 Jun. 27, 2024

(30) Foreign Application Priority Data

Dec. 22, 2022 (EP) ..... 22216217

(51) Int. Cl.
*F04C 18/02* (2006.01)
*F04C 25/02* (2006.01)
*F04C 27/00* (2006.01)

(52) U.S. Cl.
CPC ..... *F04C 18/0215* (2013.01); *F04C 18/0223* (2013.01); *F04C 18/0284* (2013.01); (Continued)

(58) Field of Classification Search
CPC ..... F04C 18/0215; F04C 18/0223; F04C 18/0284; F04C 27/005; F04C 27/007
See application file for complete search history.

(56) References Cited

U.S. PATENT DOCUMENTS 4,453,899 A * 6/1984 Hiraga ..... F01C 19/08 418/142
4,462,771 A 7/1984 Teegarden
(Continued)

FOREIGN PATENT DOCUMENTS

DE 601 26 695 T2 12/2007
EP 1 132 573 B1 2/2007
(Continued)

OTHER PUBLICATIONS

English translation of JPH06330872 by PE2E, Mar. 28, 2024.*
(Continued)

*Primary Examiner* — Deming Wan
(74) *Attorney, Agent, or Firm* — Oblon, McClelland, Maier & Neustadt, L.L.P.

(57) ABSTRACT

A vacuum pump in accordance with the invention, in particular a scroll vacuum pump, comprises a first spiral element that has a first wall that extends spirally about a first axis, that extends in an axial direction from a first support, and that has a first free end face facing away from the first support, and a second spiral element that has a second wall that extends spirally about a second axis, that extends in the axial direction from a second support, and that has a second free end face facing away from the second support, wherein the first spiral element and the second spiral element are movable relative to one another and are arranged such that the first wall and the second wall sealingly engage into one another while forming pumping spaces, wherein the free end face of at least one of the walls has a recess, in particular a groove, which extends in a longitudinal direction of the wall and in which at least one seal is movably arranged, and wherein the recess is laterally bounded by at least one inner wall that extends at least sectionally, preferably continuously, obliquely to the axial direction and that is configured to cooperate with a side wall of the seal extending at least
(Continued)

Figure 1:
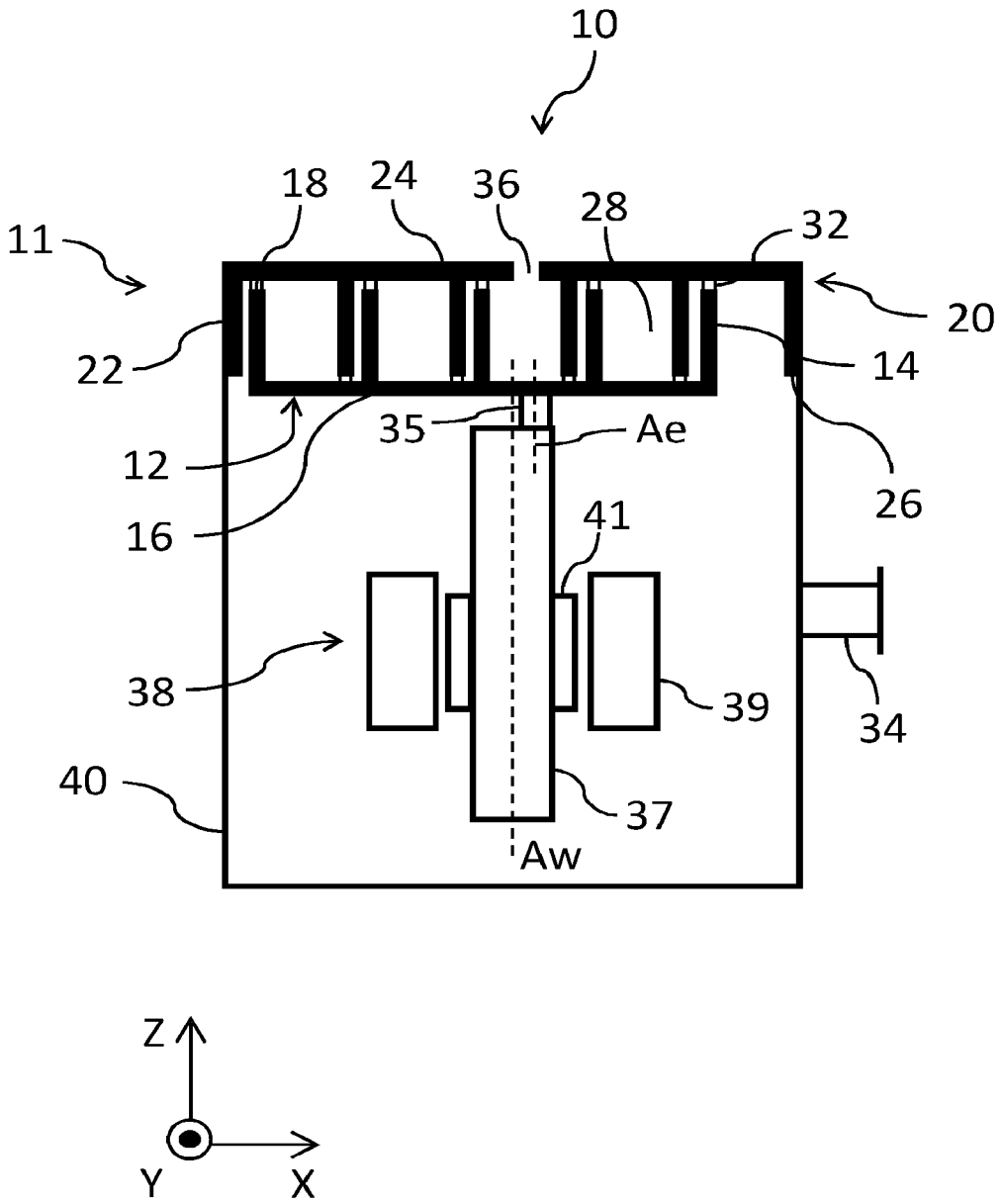

sectionally, preferably continuously, obliquely to the axial direction.

18 Claims, 13 Drawing Sheets

(52) U.S. Cl.
CPC ..... *F04C 25/02* (2013.01); *F04C 27/005* (2013.01); *F04C 2220/10* (2013.01)

(56) References Cited

U.S. PATENT DOCUMENTS

| | | | | |
|---|---|---|---|---|
| 4,655,697 | A * | 4/1987 | Nakamura | F01C 19/08 418/57 |
| 4,730,375 | A | 3/1988 | Nakamura et al. | |
| 4,732,550 | A | 3/1988 | Suzuki et al. | |
| 8,967,986 | B2 | 3/2015 | Harashima et al. | |
| 9,353,748 | B2 | 5/2016 | Hockliffe et al. | |
| 2012/0134862 | A1 * | 5/2012 | Hockliffe | F04C 27/005 418/55.1 |
| 2016/0327042 | A1 | 11/2016 | Shaffer et al. | |

FOREIGN PATENT DOCUMENTS

| | | | | |
|---|---|---|---|---|
| EP | 3 153 706 | A1 | 4/2017 | |
| EP | 3 739 166 | A2 | 11/2020 | |
| JP | H06330872 | A * | 5/1993 | F04C 27/005 |
| JP | 6-272679 | A | 9/1994 | |
| JP | 8-232858 | A | 9/1996 | |
| JP | 2007-162622 | A | 6/2007 | |

OTHER PUBLICATIONS

Extended European Search Report issued Mar. 31, 2023, in corresponding European Patent Application No. 22216217.4 (with English Translation of Category of Cited Documents), 10 pages.

* cited by examiner

VACUUM PUMP WITH MOVABLE TRAPEZOIDAL SEAL

The invention relates to a vacuum pump, in particular a scroll vacuum pump.

A scroll vacuum pump is a displacement pump that compresses against atmospheric pressure and that can be used as a compressor, among other things. A scroll vacuum pump is, for example, known from the document EP 3 153 706 B1.

Scroll vacuum pumps are also referred to as spiral vacuum pumps or spiral fluid conveying devices and can be used to generate a vacuum at a recipient connected to the gas inlet. The pumping principle underlying a scroll vacuum pump is known from the prior art and is explained below. A pump stage of a scroll vacuum pump has two spiral cylinders that are plugged into one another, for example Archimedean spiral cylinders, that are also referred to as spiral elements below. Each spiral element in this respect consists of a wall that extends in an axial direction from a support and that has a free end face facing away from the support. The spiral elements are plugged into one another such that the spiral elements sectionally enclose crescent-shaped volumes. In this respect, one spiral is stationary, while the other spiral can be moved along a circular path via an eccentric drive. The movable spiral thus performs a so-called centrally symmetrical oscillation, which is also called "wobbling". A crescent-shaped volume enclosed between the spiral cylinders continues to migrate within the spiral elements during the wobbling of the movable spiral, whereby, by means of the migrating volume, gas is conveyed radially inwardly from a radially outwardly disposed gas inlet to a gas outlet located at the spiral center.

Fluids such as greases or oils can generally be used to seal a pumping space of vacuum pumps. A piston pump, for example, generally has a gap between the pumping space and the piston. In a fluid-sealed or fluid-lubricated design, this gap is filled by a fluid, usually oil or grease, during the operation of the pump, with the fluid acting as a seal between the piston and the pumping space. A disadvantage of such pumps is that the media conveyed by the pump, such as gases or vapors, can react with the fluids used as seals, which can in particular reduce the sealing effect.

For this reason, so-called dry solutions, in which the conveyed media do not come into contact with fluids, are preferred. Sliding or slipping seals made of chemically resistant materials, usually plastics, are generally used here.

To seal the pumping spaces of conventional scroll vacuum pumps, seals are in each case provided at the end faces of the spiral walls. For example, the document EP 3 153 706 B1 discloses a seal that is arranged at a free end face of a wall of a spiral element. The disadvantage of such sliding or grinding seals is that they are usually subject to wear, due to the constant sliding friction, and often only have a limited service life.

It is therefore an object of the present invention to provide a vacuum pump having an improved service life.

This object is satisfied in accordance with the invention by a vacuum pump having the features of claim 1 and in particular in that the vacuum pump comprises a first spiral element that has a first wall that extends spirally about a first axis, that extends in an axial direction from a first support, and that has a first free end face facing away from the first support, and a second spiral element that has a second wall that extends spirally about a second axis, that extends in the axial direction from a second support, and that has a second free end face facing away from the second support, wherein the first spiral element and the second spiral element are movable relative to one another and are arranged such that the first wall and the second wall sealingly engage into one another while forming pumping spaces, the free end face of at least one of the walls has a recess, in particular a groove, which extends in a longitudinal direction of the wall and in which at least one seal, preferably at least partly—in particular completely—made from an elastic material, is movably arranged, and the recess is laterally bounded by at least one inner wall that extends at least sectionally, preferably continuously, obliquely to the axial direction and that is configured to cooperate with a side wall of the seal that extends at least sectionally, preferably continuously, obliquely to the axial direction.

When the pump is in operation, the pressure difference between adjacent pumping spaces creates a force that causes the movable seal in the recess to be pushed to the side and upwardly against a surface of the other support. In this respect, the oblique inner wall of the recess and the oblique side wall of the seal interact. On the one hand, this geometry enables the seal to move further out of the recess when it experiences abrasion, i.e. an automatic abrasion compensation takes place. On the other hand, the seal is secured in the recess, for example in a pre-assembly state or in a state of rest.

The inner wall is in particular inclined such that the inner wall converges in the direction of the free end face of the wall so that the recess narrows or becomes narrower in the direction of its opening.

Furthermore, the recess can be laterally bounded by a first inner wall and a second inner wall that both extend at least sectionally, preferably continuously, obliquely to the axial direction. Both inner walls in particular converge or, in other words, the two inner walls converge towards one another so that the recess more and more narrower from its base towards its opening. The two side walls of the seal can likewise extend at least sectionally, preferably continuously, obliquely to the axial direction. The two side walls in particular converge so that the seal slims or tapers upwardly in its assembled position.

Both spiral elements preferably have a recess and a seal of the kind described above. This means that provision can be made that the first free end face of the first wall and the second free end face of the second wall each have a recess, in particular a groove, which extends in the longitudinal direction of the wall and in which at least one seal is movably arranged in each case, wherein at least one inner wall of the respective recess extends obliquely to the corresponding axial direction and the inner wall is configured to cooperate with a side wall of the corresponding seal extending obliquely to the axial direction.

By providing a seal at a respective end face of both walls, an optimal sealing of the pumping spaces can be ensured.

If required, an inclination of the inner wall to the axial direction can furthermore vary in the longitudinal direction and/or an inclination of the side wall to the axial direction can vary in the longitudinal direction.

Furthermore, an inclination of the inner wall to the axial direction can vary in the axial direction and/or an inclination of the side wall to the axial direction can vary in the axial direction, whereby the force distribution over the seal can be set even more precisely and can be adapted to the operating states even more precisely.

For an optimal functional matching between the recess and the seal, the inclination of the inner wall of the recess can in this respect substantially correspond to the inclination of the side wall of the seal.

To be able to control the amount of the seal that projects from the recess during operation of the pump, a maximum horizontal extent of the seal can be greater than a width of the opening of the recess and/or a maximum axial extent of the seal can be greater than a depth of the recess.

Furthermore, at least one elastic preloading means for preloading the seal in a direction from the base of the recess to the opening of the recess can be arranged between a lower side of the seal and a base of the recess. This enables, among other things, an improvement of the sealing effect and an acceleration of a running-in process or grinding-in process of the seal.

Furthermore, at least one inner wall of the recess cooperating with the seal during operation of the vacuum pump can be structured at least sectionally. The inner wall can in particular have depressions and/or elevated portions. Due to the structuring of the inner wall, the seal adheres better to the inner wall. This, in turn, enables a better fixing of the seal in its exposed state, i.e. in a state in which the upper side of the seal is pressed against a surface of an oppositely disposed support and in which a part of the seal projects from the recess. Alternatively or additionally, the seal can have structured side walls.

For a reduced wear rate, the seal can have a trapezoidal cross-section. The seal can in particular have a cross-section in the form of an isosceles trapezoid. With a trapezoidal basic shape, the area of the seal contacting the support increases with increasing abrasion, while the force acting on the seal remains substantially constant due to a pressure difference between adjacent pumping spaces. The resulting lower contact force per unit area ensures reduced abrasion, while the sealing effect remains sufficiently good due to the enlarged sealing surface.

To simplify the assembly of the seal into the recess, the seal can be formed in two or more parts. The seal can in particular be formed in two or more parts in the longitudinal direction and/or in a radial direction of the spiral elements.

In this respect, the parts of the seal can have connection means for connecting the parts. The connection means can act in a form-fitting manner. For example, the connection means comprise a tongue and groove.

In accordance with one embodiment, a part of the wall that has the obliquely extending inner wall can be plastically bent over so that the seal is optimally seated in the recess and the manufacturing process can be further simplified. Consequently, the manufacturing costs can also be reduced.

However, a configuration in which a part of the wall having the first inner wall is longer than a part of the wall having the second inner wall is also possible. This enables a simple tipping or screwing of the seal into the recess during the assembly of the seal.

In accordance with a further embodiment, the seal can have cuts at its upper side and/or lower side and/or at one or both side walls. The cuts can be arranged spaced apart from one another along the longitudinal direction and can have an angle of inclination of less than 90°, preferably between 10 and 70°. Due to the cuts, openings are formed that are oriented toward the high-pressure side, i.e. in the longitudinal direction towards the pump outlet.

The present invention further relates to a method of manufacturing a spiral element for a vacuum pump in accordance with at least one of the embodiments described above. The method comprises at least the following steps:

providing a spiral element that has a wall that extends spirally about a second axis, that extends in the axial direction from a support, and that has a free end face facing away from the support, wherein the free end face has a recess, in particular a groove, that extends in a longitudinal direction of the wall, wherein the recess is laterally bounded by at least one inner wall that is formed at a section of the wall that is associated with the free end face and that extends substantially in parallel with the axial direction, inserting a seal into the recess, and at least sectionally plastically bending over the section of the wall, in particular by means of a flanging tool, so that the inner wall extends at least sectionally, preferably continuously, obliquely to the axial direction.

The vacuum pump in accordance with the invention is characterized by an increased service life.

Figure 2:
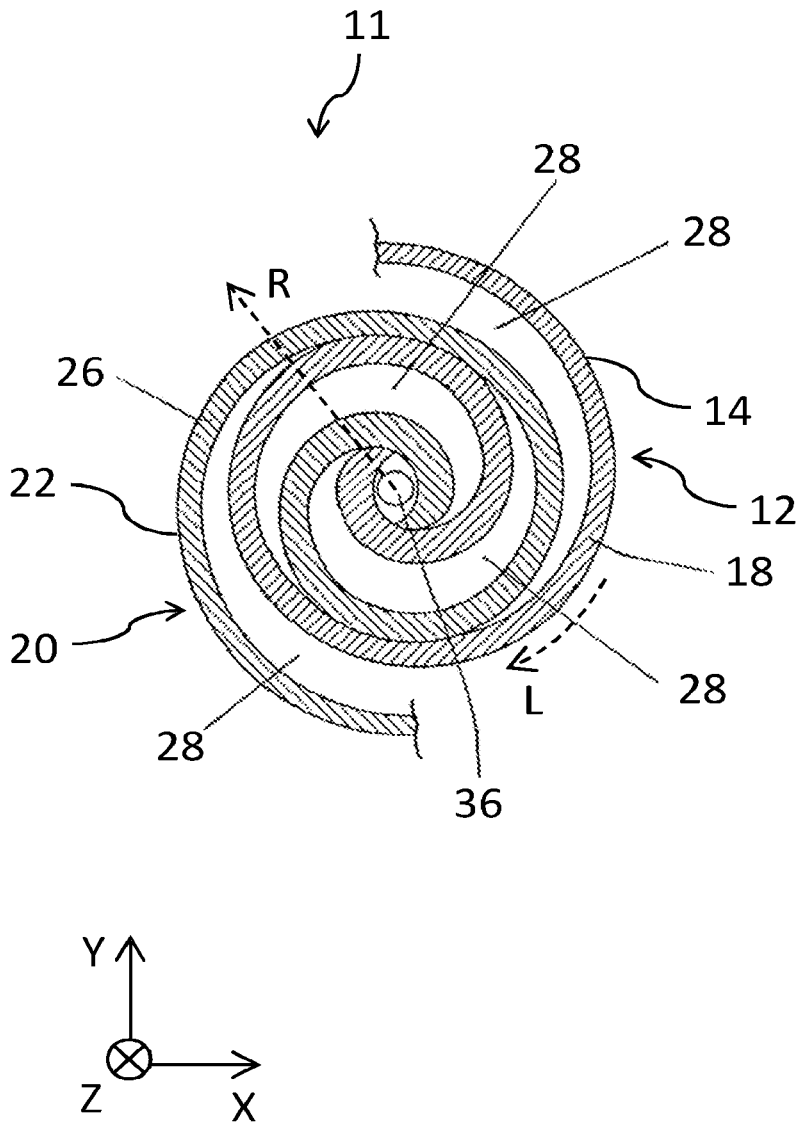
Figure 9:
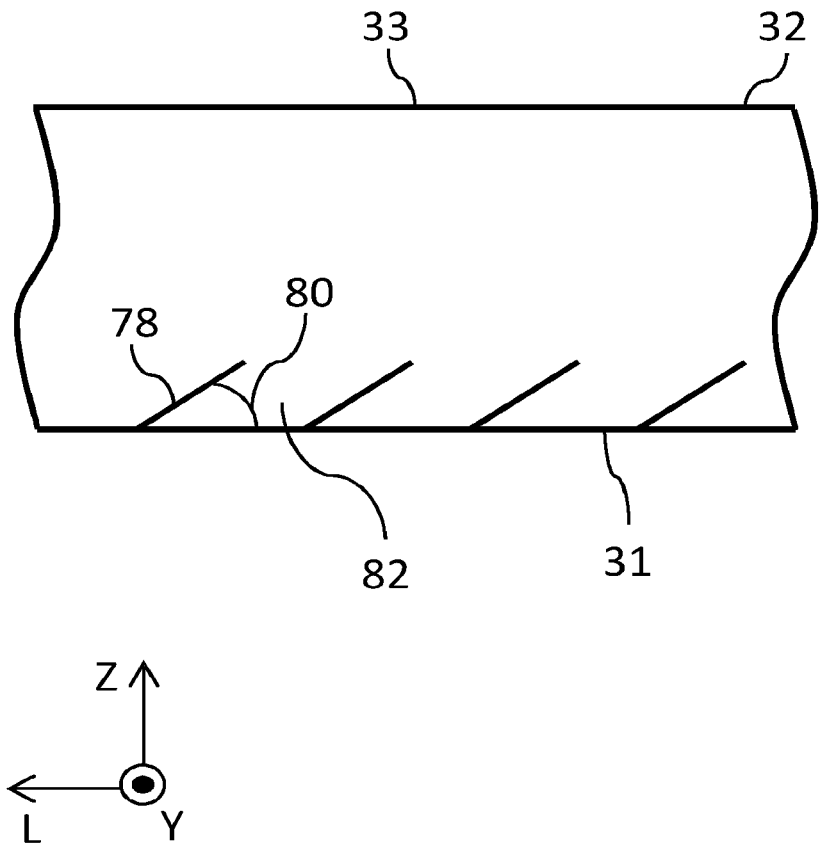
Figure 10:
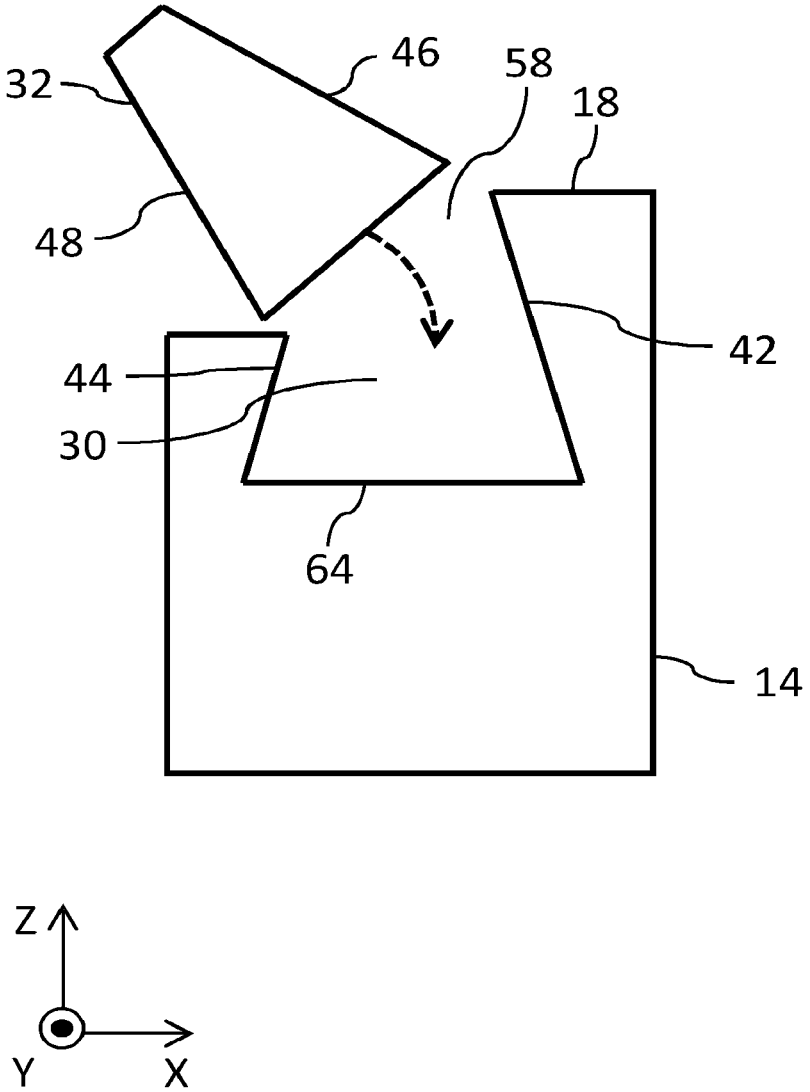
Figure 11:
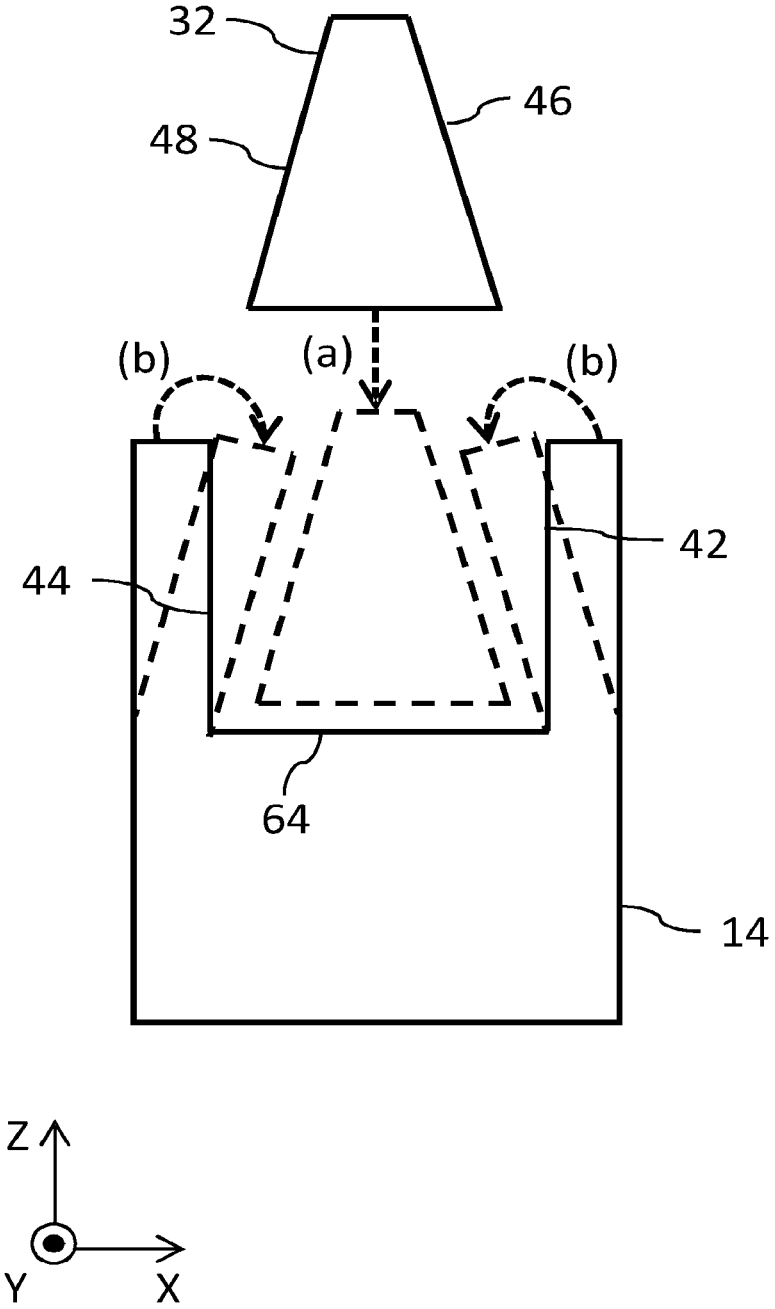
Figure 12:
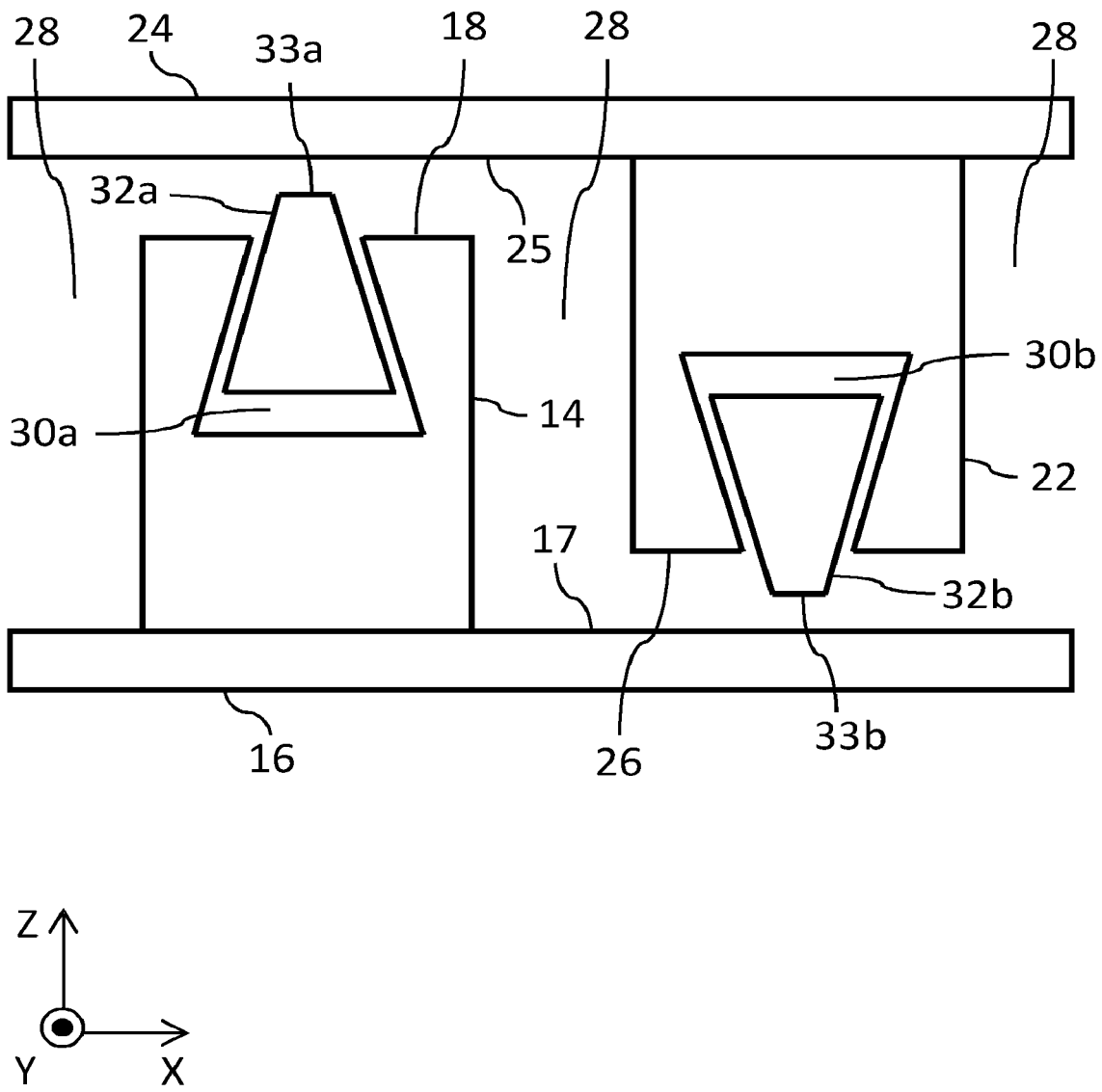

The invention will be described in the following by way of example with reference to advantageous embodiments and to the enclosed drawings. There are shown, schematically in each case:

FIG. 1 a longitudinal section through a scroll vacuum pump in accordance with an embodiment;

FIG. 2 a cross-section of the pump stage of the scroll vacuum pump of FIG. 1;

FIGS. 3-7 longitudinal sections through a wall of a spiral element in accordance and 8A-8B with various embodiments;

FIG. 9 a side view of a seal in accordance with an embodiment;

FIGS. 10, 11 exemplary representations of an assembly process of the seal into the recess in accordance with various embodiments; and FIG. 12 a longitudinal section through a part of a pump stage of a scroll vacuum pump in accordance with one embodiment.

FIG. 1 shows a vacuum pump configured as a scroll vacuum pump 10. It comprises a pump housing 40 in which an inlet 34 and an outlet 36 are provided. An outlet of a recipient, not shown, can be connected to the inlet 34. A scroll pump stage 11 provided in the pump housing 40 can suck in a pumping medium (gas or liquid) from the recipient through the inlet 34 and can convey it to the outlet 36.

The pump stage 11 comprises a first spiral element 12 and a second spiral element 20. The first spiral element 12 has a first wall 14 that extends spirally about a first axis, that extends in an axial direction Z from a first support 16, and that has a first free end face 18 facing away from the first support 16 (see also FIG. 2). The second spiral element 20 likewise has a second wall 22 that extends spirally about a second axis, that extends in the axial direction Z from a second support 24, and that has a second free end face 26 facing away from the second support 24. The second support 24 of the second spiral element 20 is connected to the housing 40 and can be formed as a part of the pump housing 40. The outlet 36 of the pump 10 extends axially through the fixed spiral element 20. The spiral walls 14, 22 each have an end face 18, 26 at which a seal 32 is arranged. The seals 32 contact the respective oppositely disposed support 24 or 16.

In the pump 10, an electric motor 38 is further located that comprises a motor stator 39 (winding) and a motor rotor 41 (runner). The electric motor 38 drives a shaft 37 that defines a shaft axis Aw. The peripheral spiral element 12 is coupled to the shaft 37 by an eccentric shaft 35 that defines an eccentric axis Ae. The axis Aw of the shaft 37 and the eccentric axis Ae extend in parallel with one another. Both shafts 37, 35 are supported by bearings (not shown). The shaft 37 furthermore comprises balancing weights (not shown) to ensure an optimal running smoothness of the pump 10.

A direction that extends in parallel with the shaft axis Aw is designated as the axial direction Z. A direction that extends perpendicular to the axial direction Z is designated as the radial direction R. A direction that extends along a respective wall 14, 22 of a spiral element 12, 22 is designated as the longitudinal direction L, i.e. the longitudinal direction L extends in an X-Y plane of the pump 10 (cf. FIG. 2).

In the operation of the pump 10, the shaft 37 rotates and the eccentric shaft 35 connected thereto performs a revolving movement about the shaft axis Aw of the shaft 37. Accordingly, the spiral element 12 performs a centrally symmetrical oscillation movement on a circular path about the shaft axis Aw. In this respect, the spiral element 12 does not rotate about its own axis Ae, which is achieved by rotation prevention mechanisms known to the skilled person. Due to this movement, closed, crescent-shaped pumping spaces 28 are produced between the spiral elements 12, 20 engaging into one another and continue to reduce their volume inwardly in the direction of the pump outlet 36. In this way, a compression of a gas sucked in via the inlet 34 occurs.

The shape of the pumping spaces 28 can be seen in FIG. 2 that shows a section of a cross-section perpendicular to the shaft 37 of a scroll pump 10. In this respect, the cross-sectional plane (X-Y plane in the drawing) extends through the mutually engaging spiral walls 14, 22 of the spiral elements 12, 20.

Since the pump 10 in accordance with FIG. 1 has a movable spiral element 12 whose support 16 is only provided with a spiral wall 14 at one side, it is a single-sided pumping system that is also referred to as a single-wrap pumping system. However, the scroll vacuum pump 10 in accordance with the invention can also be designed as a double-sided pumping system. Unlike the single-sided design in accordance with FIG. 1, the peripheral spiral element of the double-sided embodiment has a support that is provided with spirally extending walls at both sides. Such a double-sided pumping system is known from the document EP 3 153 706 B1, for example.

Figure 3:
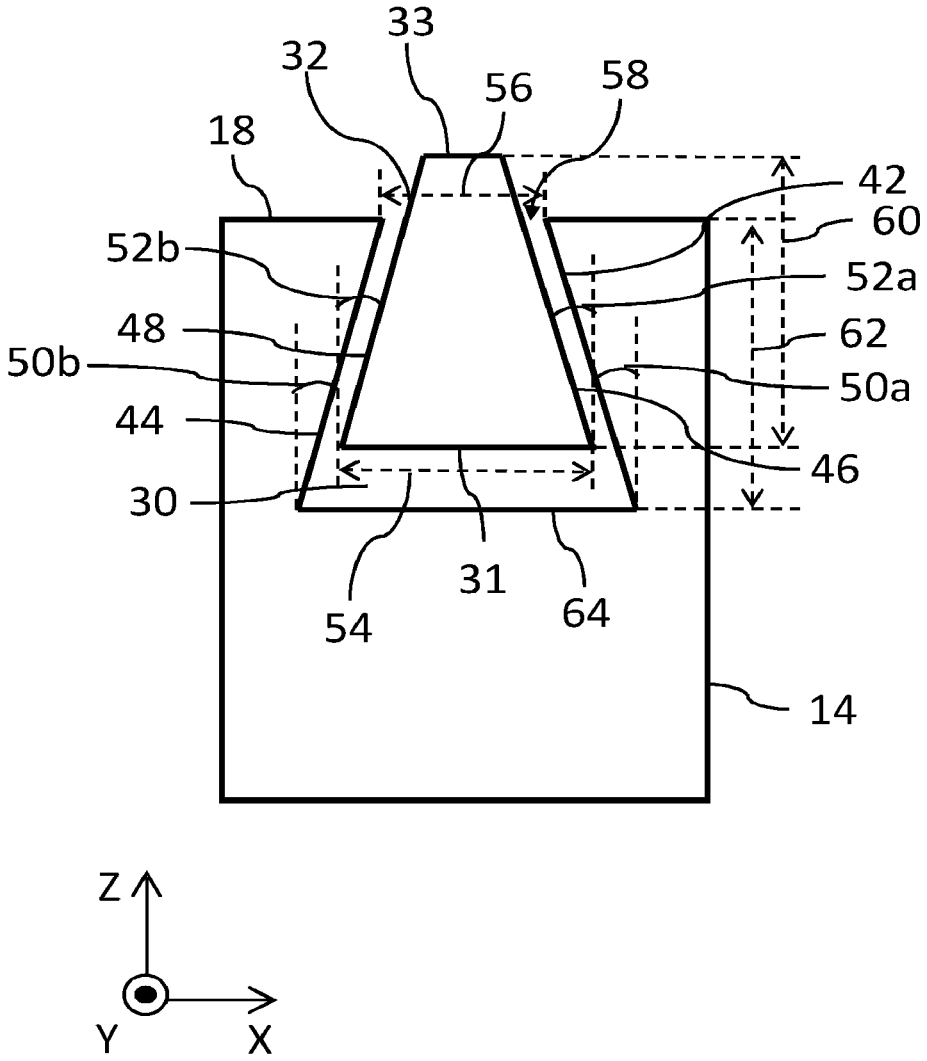

FIG. 3 shows a detailed representation of the scroll pump 10 of FIG. 1, namely a section through the first wall 14 in the region of the first free end face 18. The first free end face 18 has a recess 30 extending in the longitudinal direction L of the wall 14. The recess 30 is formed as a groove or indentation, is bounded by two lateral inner walls 42, 44 and a base 64, and upwardly has an opening 58 with a width 56. The base 64 is formed in parallel with the radial direction R.

A seal 32, which is also designated as a tip seal, is movably arranged in the recess 30. The seal 32 is made of an elastic and chemically resistant plastic, for example of a polytetrafluoroethylene (PTFE) material. The seal 32 has a first side wall 46, a second side wall 48, an upper side 33, and a lower side 31.

The side walls 46, 48 of the seal 32 extend obliquely to the axial direction Z. The first side wall 46 in particular has a first inclination 52*a* to the axial direction Z and the second side wall 48 in particular has a second inclination 52*b* to the axial direction Z. The inclinations 52*a*, 52*b* have equal amounts or angles, i.e. the seal 32 has the form of an isosceles trapezoid in cross-section. For example, the first and second inclinations 52*a*, 52*b* have an angle between 10° and 60°, preferably between 25° and 45°. Due to the trapezoidal shape, the surface pressure at the upper side 33 of the seal 32 successively decreases as the wear of the seal 32 increases, whereby a reduction in the wear rate can be achieved.

The horizontal extent of the lower side 31 of the seal 32 defines a maximum horizontal extent 54 of the seal 32 that is preferably greater than the width 56 of the opening 58 of the recess 30. A maximum axial extent 60 of the seal 32 can be greater than a depth 62 of the recess 30. By selecting the aforementioned dimensions, the part of the seal 32 that projects from the recess 30 during operation of the pump 10 can be set.

The inner walls 42, 44 of the recess 30 likewise extend obliquely to the axial direction Z. The first inner wall 42 in particular has a first inclination 50*a* to the axial direction Z and the second inner wall 44 in particular has a second inclination 50*b* to the axial direction Z, wherein the inclinations 50*a*, 50*b* have equal amounts, i.e. the recess 30 tapers uniformly in the direction of its opening 58 (in the Z direction in FIG. 3). The first and second inclinations 50*a*, 50*b* in particular have an angle between 10° and 60°, preferably between 25° and 45°.

Figure 4:
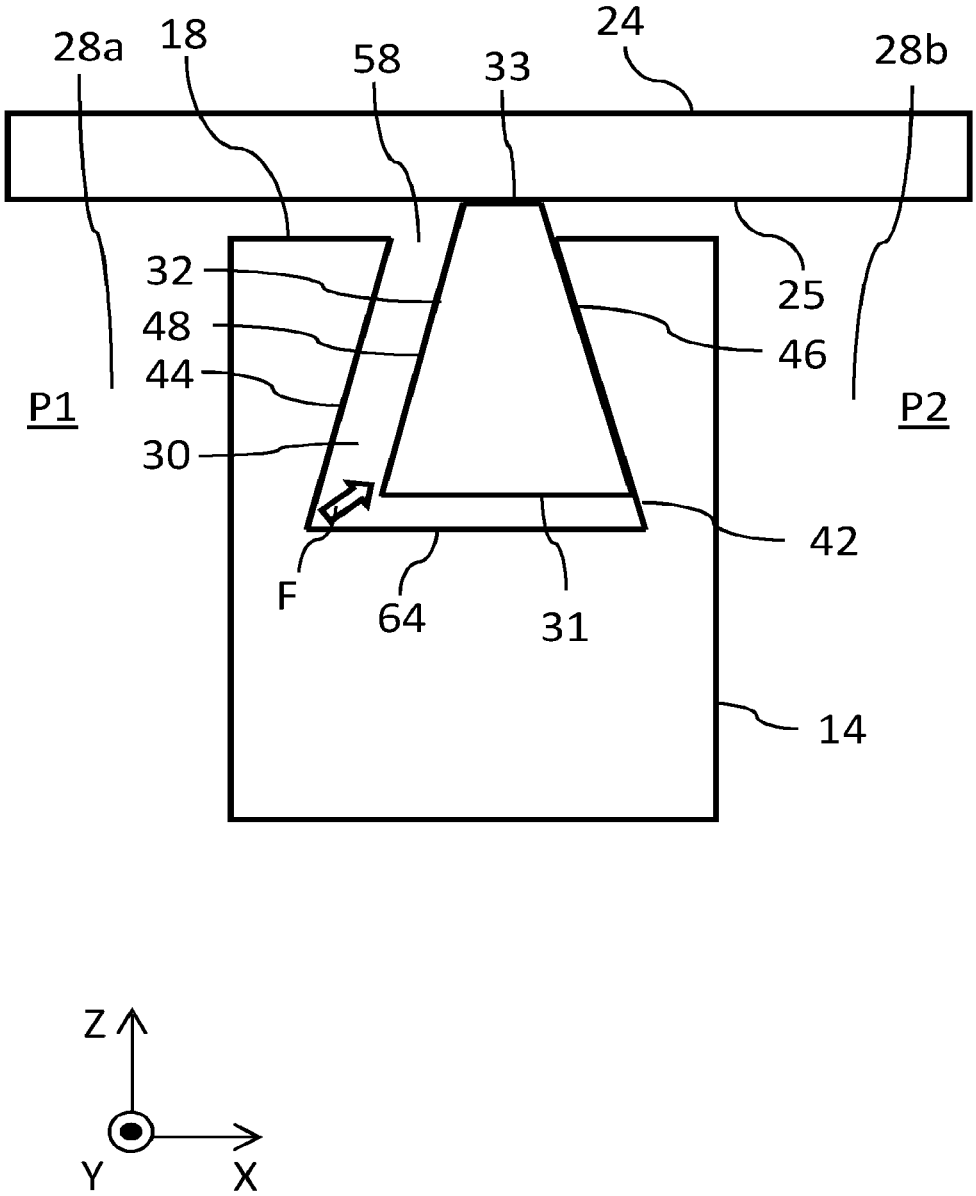
Figure 5:
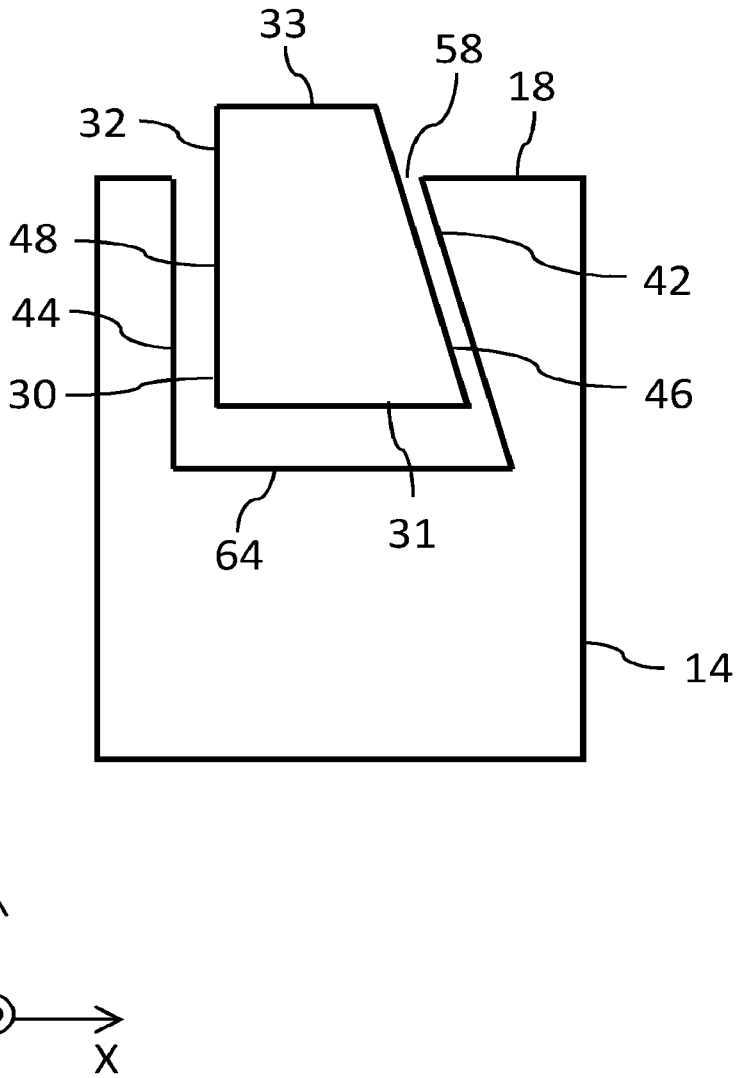

The inner walls 42, 44 of the recess 30 are each configured to cooperate with the side walls 46, 48 of the seal 32 extending obliquely to the axial direction Z. The pumping medium is in particular increasingly compressed towards the pump outlet 36. Consequently, the closer the pumping spaces 28 are to the pump outlet 36, the higher the pressure in the pumping spaces 28 is. For example, as shown in FIG. 4, a first pumping space 28*a* has a first pressure P1 whose magnitude is greater than the magnitude of a second pressure P2 in an adjacent, second pumping space 28*b* if the first pumping space 28*a* is closer to the outlet 36 than the second pumping space 28*b*. This pressure difference (|P1−P2|) causes a force F to act on the seal 32 (cf. the arrow in the lower left region of the recess).

The force F has an axial component and a radial component so that the seal 32 is pressed against a surface 25 of the second support 24 and against the first inner wall 42 of the recess 30 (operating state of the seal 32). Here, the upper side 33 of the seal 32 slides against the surface 25 of the second support 24, while the first side wall 46 of the seal 32 is pressed against the first inner wall 42 of the recess 30. Consequently, a portion of the axial component of the force F is absorbed by a section of the first inner wall 42 of the recess 30 that is in contact with the first side wall 46 of the seal 32, while the remaining portion of the axial component of the force F is absorbed by a section of the surface 25 of the second support 24 that is in contact with the upper side 33 of the seal 32. Due to this distribution of force, the surface pressure at the upper side 33 of the seal 32 can be reduced, whereby reduced wear of the seal 32 can be achieved. At the same time, adjacent pumping spaces 28 are optimally sealed off from one another. As a result, a scroll vacuum pump 10 can thus be provided that is characterized by reduced maintenance costs and an improved service life.

The aforesaid advantages can also be achieved if the inclinations 50*a*, 50*b* of the two inner walls 42, 44 of the recess 30 have different amounts. For example, in the embodiment shown in FIG. 5, only one of the inner walls 42 extends obliquely to the axial direction Z, while the oppositely disposed inner wall 44 extends in parallel with the axial direction Z. In this respect, it is advantageous if the side 42 with the lower pressure extends obliquely to the axial direction Z so that here, too, a portion of the force F acting on the seal 32 is transmitted to the oblique side wall 46 of the seal 32. Accordingly, the seal 32 has a cross-section in the form of a rectangular trapezoid here.

In accordance with an embodiment that is not shown, the inclination 50 of the inner wall 42, 44 varies in the longitudinal direction L. For example, the inclination 50 of the inner wall 42, 44 can increase in the longitudinal direction L as the distance from the outlet 36 decreases. Furthermore, a design is possible in which only one longitudinal section of the recess 30 L has an oblique inner wall 42, 44 in the longitudinal direction.

Additionally or alternatively, the inclinations 50 of the inner wall 42, 44 can also vary in the axial direction Z. The inclination 50 of the inner wall 42, 44 can in particular increase or decrease in the axial direction Z as the distance from the opening 58 of the recess 30 decreases. For example, a section of the inner wall 42, 44 near the base 64 of the recess 30 can have a smaller or larger inclination 50 than a section of the inner wall 42, 44 near the opening 58 of the recess 30, or vice versa. Accordingly, the inclination 52 of the side wall 46, 48 of the seal 32 can be adapted to the inclination 50 of the inner wall 42, 44 of the recess 30, i.e. the inclination 52 of the side wall 46, 48 of the seal 32 can also vary in the axial direction Z with respect to the axial direction Z. In particular, the inclination 50 of the inner wall 42, 44 can substantially correspond to the inclination 52 of the side wall 46, 48. Different operational requirements can thereby be addressed.

Accordingly, the inclination 52 of the side wall 46, 48 of the seal 32 to the axial direction Z can also vary in the longitudinal direction L and/or in the axial direction Z. In particular, the inclination 50*a*, 50*b* of the inner wall 42, 44 preferably substantially corresponds to the inclination 52 of the side wall 46, 48, i.e. the inclination 52 of the side wall 46, 48 of the seal 32 is preferably complementary to the inclination 50 of the inner wall 42 or 44 of the recess 30. This provides an optimal areal contact of the seal 32 at the inner wall 42, 44 during the operation of the pump 10.

Figure 6:
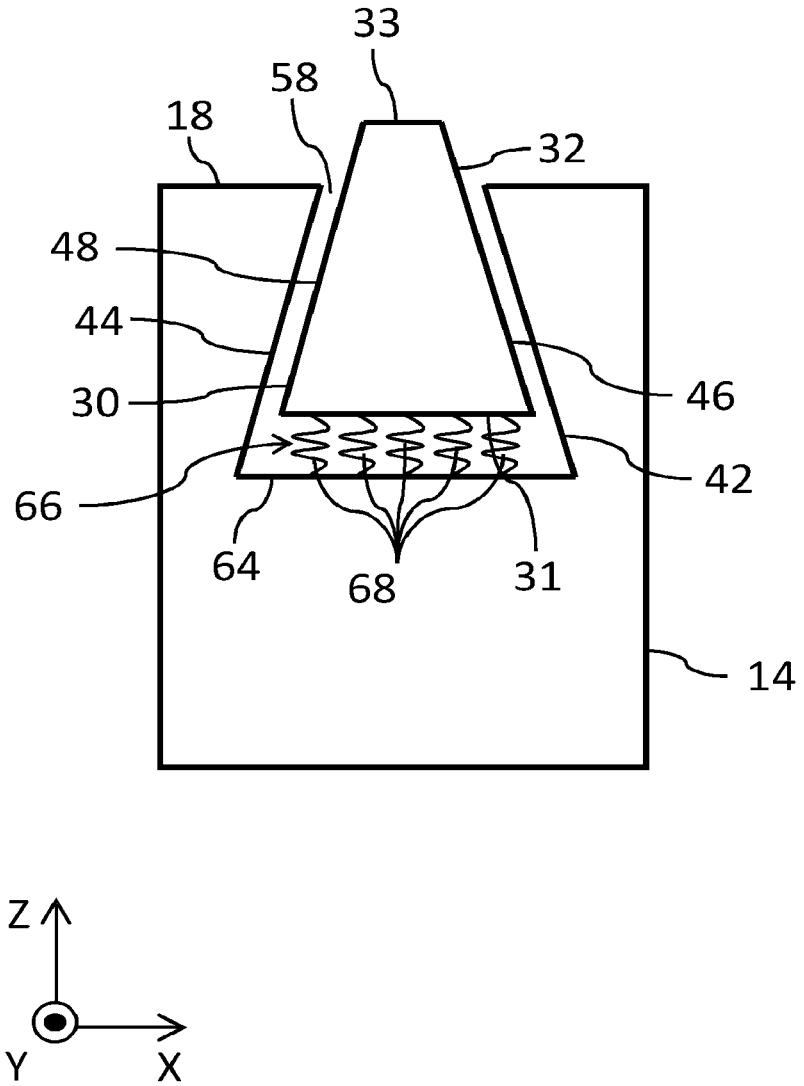
Figure 7:
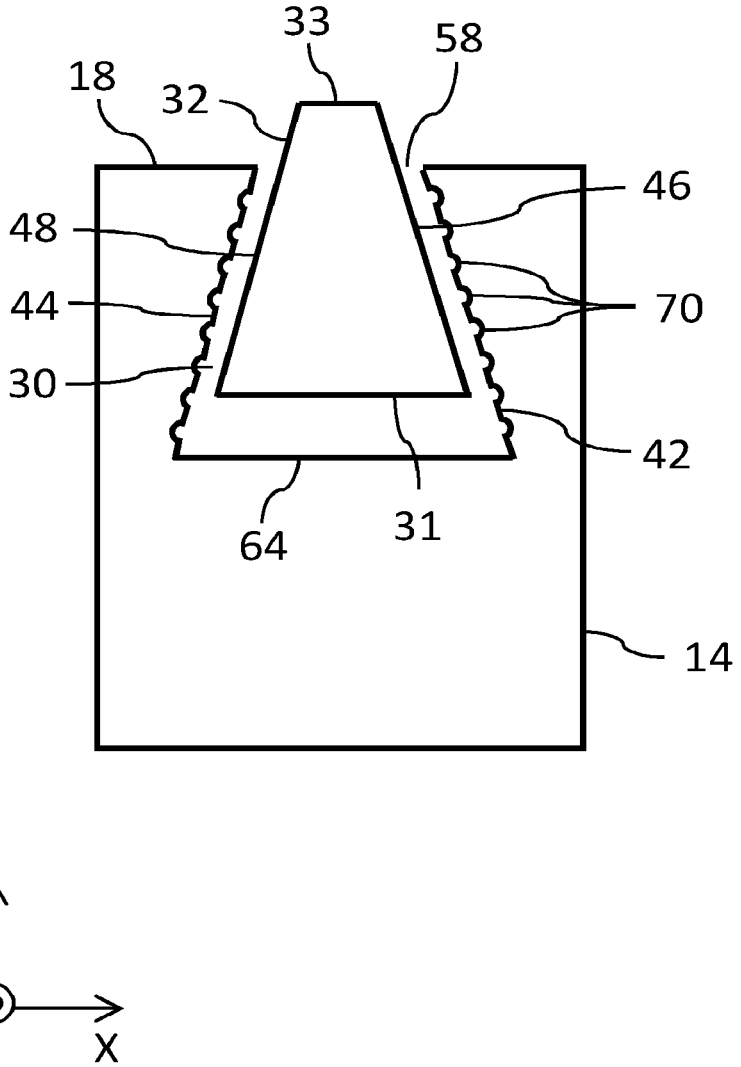

The exemplary embodiment of a wall 14, 22 of a spiral element 12, 20 of a scroll vacuum pump 10 in accordance with the invention shown in FIG. 6 substantially differs from that shown in FIG. 3 in that at least one elastic preloading means 66 for preloading the seal 32 in a direction from the base 64 of the recess 30 to the opening 58 of the recess 32 is arranged between the lower side 31 of the seal 32 and the base 64 of the recess 30 (in the Z direction in FIG. 6). The preloading means 66 is designed as five springs 68 arranged next to one another in the radial direction R. However, the preloading means 66 can also comprise only one or any desired plurality of springs 68. Here, the springs 68 are symbolic of any desired single-piece or multi-piece elastic element or a plurality of elastic elements. Additionally or alternatively thereto, the preloading means 66 can comprise a porous foam (not shown). The elastic properties of the preloading means 66 can be adapted to the respective requirements. The properties can also vary locally and/or the preloading means 66 is not provided continuously but only sectionally or at points.

The preloading means 66 causes, among other things, the seal 32 to also be pressed against the surface 25 of the support 24 in a state of rest of the pump 10. This enables an acceleration of the grinding-in process of the seal 32 and thus of the running-in process of the pump 10.

The inner walls 42, 44 of the recess 30 can be structured. In the embodiment shown in FIG. 7, the inner walls 42, 44 have depressions 70 or grooves that are formed equidistantly along the respective inner wall 42, 44 and that extend in the longitudinal direction L. In addition or alternatively thereto, the inner walls 42, 44 can also be structured with elevated portions (not shown) in the form of grooves and/or ribs and/or knobs extending in the longitudinal direction L. The depth or height of the structuring is adapted to the respective requirements, for example to an elasticity of the seal 32.

The structuring can generally vary in the axial direction Z and/or in the longitudinal direction L of the recess 30 and/or can only be present in sections. For example, a structuring is conceivable in which the density of the structuring increases the closer the respective section of the inner wall 42, 44 is to the opening 58 of the recess 30. Similarly, the inner wall can also only be sectionally structured, for example, only in an upper third or an upper half of the inner wall 42, 44 near the opening 58. Furthermore, it is understood that also only one of the inner walls 42, 44 can be structured. In particular, only the inner wall 42 that is acted on by the seal 32 during operation of the pump can be structured (see FIG. 4). The structuring of the inner wall 42, 44 enables a better fixing of the seal 32 in its operating state.

Irregular structurings (e.g. by roughening) are also conceivable. Furthermore, the seal 32 can be formed in two or more parts. The seal can in particular be formed in two or more parts in the longitudinal direction L and/or in the radial direction R. In this respect, the two parts can each have a cross-section in the form of a rectangular trapezoid.

Figure 8A:
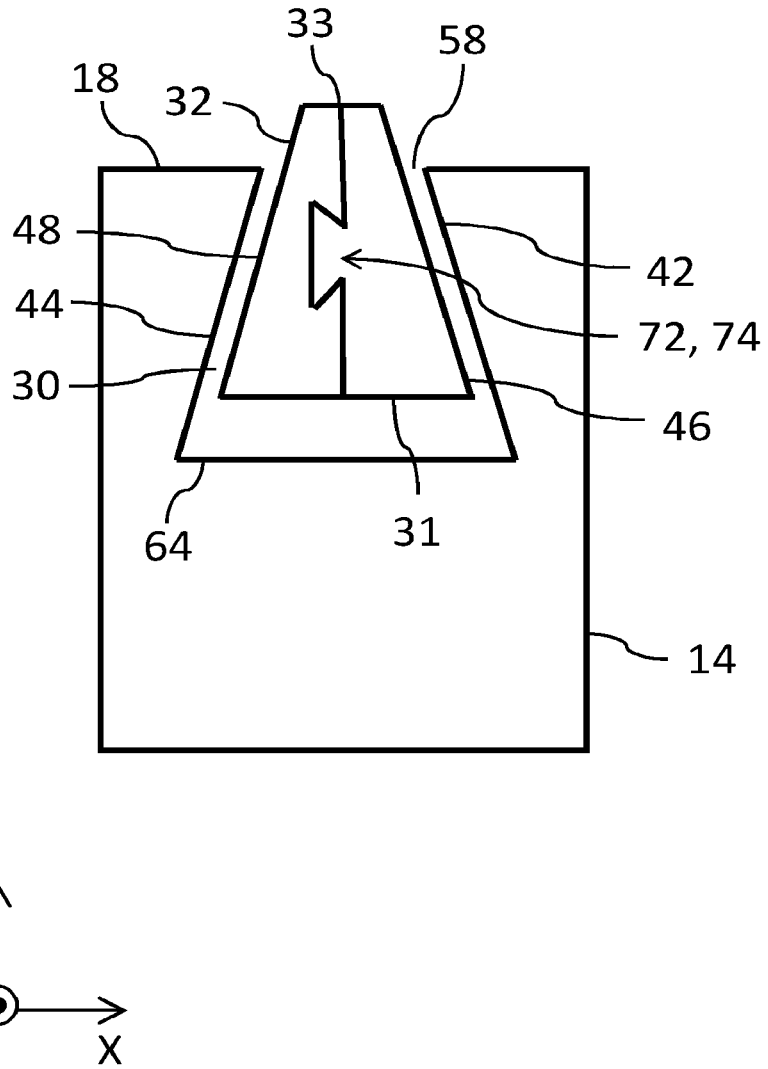
Figure 8B:
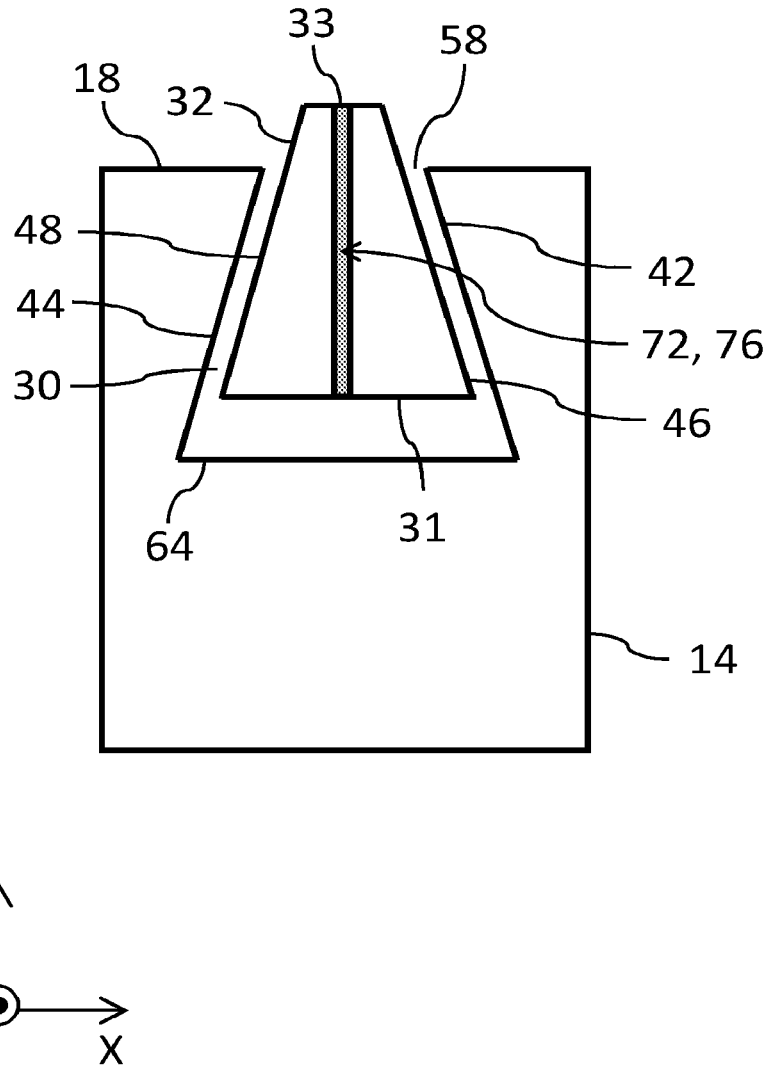

In the embodiments shown in FIGS. 8A and 8B, the seal 32 consists of two parts arranged next to one another in the radial direction R. However, the seal 32 can also consist of two parts arranged above one another in the axial direction Z (not shown). This enables an easy insertion or assembly of the seal 32 into the recess since the parts of the seal 32 can be successively plugged into the recess 30.

So that the parts of the seal 32 do not slip against one another or form a gap between the parts in the assembled state, the parts of the seal 32 can have a connection means 72 for connecting the parts. In the embodiment shown in FIG. 8A, the connection means acts in a form-fitting manner. The connection means 72 in particular comprise a tongue and groove 74 so that, on the assembly of the seal 32, the two parts can be connected by a pressing into one another.

However, the connection means 72 acting in a form-fitting manner are not limited to a tongue and groove 74, but can, for example, also comprise ribs and grooves engaging into one another (not shown).

In the embodiment shown in FIG. 8B, the two parts of the seal are arranged next to one another in the radial direction R and each have a cross-section in the form of an isosceles trapezoid. A connection means 72 in the form of an adhesive 76, such as a resin or a glue, is introduced between the parts and is applied to one or both of the parts during the assembly of the seal 32. However, the adhesive 76 can also be omitted so that the parts cooperate in a friction-locked manner.

In the embodiment shown in FIG. 9, the seal 32 has incisions 78 at its lower side 31 that extend obliquely into the seal 32 from the lower side 31. The incisions 78 are arranged along the longitudinal direction L and have an angle of inclination 80 of less than 90°, preferably between 10° and 70°. Due to the incisions or cuts 78, openings and lips or tabs 82 are formed that are oriented or open in the direction of the high-pressure side, i.e. in the direction of the outlet 36. The tabs 82 formed by the incisions 78 prevent a backflow between the lower side 31 of the seal and the base 64 of the recess 30 in the longitudinal direction L of the recess 30. Furthermore, if the incisions 78 are suitably designed, the tabs 82 can provide an elastic contact force—in addition to or as an alternative to the preloading means 66 (see FIG. 6).

It is understood that the incisions 78 are made in any desired sides 31, 33, 46, 48 of the seal 32.

In the embodiment shown in FIG. 10, a part of the wall 14 having the first inner wall 42 is longer than a part of the wall 14 having the second inner wall 44. In other words, the recess 30 shown in FIG. 10 differs from those shown in FIGS. 3-8B in that it has a larger opening 58. This enables a simple tipping or screwing of the seal 32 into the recess.

In the embodiment shown in FIG. 11, the sections of wall 14 comprising the inner walls 42, 44 have a plastically deformable design and first form a groove that extends in the longitudinal direction L of the walls 14, 22 and that has inner walls 42, 44 extending in parallel with the axial direction Z. When assembling the seal 32, the seal 32 is first inserted into the groove (cf. dashed straight arrow). Since the opening of the groove is wider than the maximum horizontal extent 54 of the seal 32, the seal 32 can simply be pushed or plugged into the groove (assembly step (a)). The two sections of the wall 14 are then bent inwardly so that a recess in accordance with the invention is formed in which the seal 32 is encompassed (cf. dashed and bent arrows, assembly step (b)). The bending over of the wall sections preferably takes place by means of a flanging tool. The wall sections can be bent over along the entire length of the spiral element 12, 20 or only sectionally at regular or irregular intervals. Alternatively, only one of the sections of the wall 14 can also be plastically deformable, while the oppositely disposed part has an oblique inner wall 44 or a straight inner wall 44 (see FIG. 5) so that only one section at one side of the wall 14 has to be bent over during the assembly of the seal 32.

It is understood that both the first spiral element 12 and the second spiral element of the pump stage 11 can be designed in accordance with the invention. In particular, as is shown in FIG. 12, the first free end face 18 of the first wall 14 and the second free end face 26 of the second wall 22 can each have a recess 30*a*, 30*b* which extends in the longitudinal direction L of the wall and in which at least one seal 32*a*, 32*b* in accordance with the invention is movably arranged in each case.

It is generally conceivable that the seal at its upper side, which cooperates with the oppositely disposed support during operation of the pump, is provided or covered with a material that is softer than the material of the base body of the seal. The softer material grinds in quickly during the running-in or grinding-in process of the seal so that this process is accelerated. For example, the softer material is pasty. Both materials can be elastic.

It is furthermore understood that features that were described with respect to specific embodiments of the invention can be combined with those of other embodiments.

REFERENCE NUMERAL LIST

10 vacuum pump
11 scroll pump stage
12 first spiral element
14 first wall
16 first support
17 surface of the first support
18 first free end face
20 second spiral element
22 second wall
24 second support
25 surface of the second support
26 second free end face
28, 28*a*, 28*b* pumping space
30 recess
30*a* recess of the first wall
30*b* recess of the second wall
31 lower side of the seal
32, 32*a*, 32*b* seal
33, 33*a*, 33*b* upper side of the seal
34 inlet
35 eccentric shaft
36 outlet
37 shaft
38 electric motor
39 motor stator
40 pump housing
41 motor rotor
42 first inner wall of the recess
44 second inner wall of the recess
46 first side wall of the seal
48 second side wall of the seal
50, 50*a*, 50*b* inclination of the inner wall
52, 52*a*, 52*b* inclination of the side wall
54 maximum horizontal extent of the seal
56 width of the opening of the recess
58 opening of the recess
60 maximum axial extent of the seal
62 depth of the recess
64 base of the recess
66 preloading means
68 springs
70 depressions
72 connection means
74 tongue and groove
76 adhesive
78 incisions in the seal
80 angle of inclination of the cuts
82 lip or tab
P1, P2 pressure in the pumping space
F force acting on the seal during pumping operation
Aw shaft axis
Ae eccentric axis
Z axial direction
R radial direction
L longitudinal direction

The invention claimed is:

1. A vacuum pump comprising a first spiral element that has a first wall that extends spirally about a first axis, that extends in an axial direction from a first support, and that has a first free end face facing away from the first support, and a second spiral element that has a second wall that extends spirally about a second axis, that extends in the axial direction from a second support, and that has a second free end face facing away from the second support, wherein the first spiral element and the second spiral element are movable relative to one another and are arranged such that the first wall and the second wall sealingly engage into one another while forming pumping spaces, wherein the free end face of at least one of the walls has a recess which extends in a longitudinal direction of the wall and in which at least one seal is arranged, wherein the recess is laterally bounded by at least one inner wall that extends at least sectionally obliquely to the axial direction and that is configured to cooperate with a side wall of the seal extending at least sectionally obliquely to the axial direction, wherein the inner wall is inclined such that the inner wall converges in a direction of the free end face of the at least one of the walls so that the recess narrows or becomes narrower in a direction of an opening of the recess, and wherein the seal is movably arranged in the recess and has a trapezoidal cross-section.

2. The vacuum pump in accordance with claim 1, wherein the vacuum pump is a scroll vacuum pump.

3. The vacuum pump in accordance with claim 1, wherein the recess is a groove.

4. The vacuum pump in accordance with claim 1, wherein the at least one inner wall extends continuously obliquely to the axial direction.

5. The vacuum pump in accordance with claim 1, wherein the side wall of the seal extends continuously obliquely to the axial direction.

6. The vacuum pump in accordance with claim 1,
wherein the recess is laterally bounded by a first inner wall and a second inner wall,
wherein the first inner wall and the second inner wall extend at least sectionally obliquely to the axial direction, and/or wherein the seal has a first and a second side wall that extend at least sectionally obliquely to the axial direction.

7. The vacuum pump in accordance with claim 6,
wherein a part of the wall having the first inner wall is longer than a part of the wall having the second inner wall.

8. The vacuum pump in accordance with claim 1,
wherein the first free end face of the first wall and the second free end face of the second wall each have a recess which extends in the longitudinal direction of the wall and in which at least one seal is movably arranged in each case, wherein at least one inner wall of the respective recess extends obliquely to the corresponding axial direction and the inner wall is configured to cooperate with a side wall of the corresponding seal extending obliquely to the axial direction.

9. The vacuum pump in accordance with claim 1,
wherein an inclination of the inner wall to the axial direction varies in the longitudinal direction and/or wherein an inclination of the side wall to the axial direction varies in the longitudinal direction.

10. The vacuum pump in accordance with claim 9,
wherein the inclination of the inner wall of the recess substantially corresponds to the inclination of the side wall of the seal.

11. The vacuum pump in accordance with claim 1,
wherein an inclination of the inner wall to the axial direction varies in the axial direction and/or wherein an inclination of the side wall to the axial direction varies in the axial direction.

12. The vacuum pump in accordance with claim 1,
wherein a maximum horizontal extent of the seal is greater than a width of the opening of the recess and/or a maximum axial extent of the seal is greater than a depth of the recess.

13. The vacuum pump in accordance with claim 1,
wherein at least one elastic preloading means for preloading the seal in a direction from the base of the recess to the opening of the recess is arranged between a lower side of the seal and a base of the recess.

14. The vacuum pump in accordance with claim 1,
wherein at least one inner wall of the recess cooperating with the seal during operation of the vacuum pump is structured at least sectionally.

15. The vacuum pump in accordance with claim 1,
wherein the seal is formed in two or more parts.

16. The vacuum pump in accordance with claim 15,
wherein the parts of the seal have connection means for connecting the parts.

17. The vacuum pump in accordance with claim 1,
wherein a part of the wall having the obliquely extending inner wall is plastically bent over.

18. A method of manufacturing a spiral element for a vacuum pump, the method comprising:
providing a spiral element that has a wall that extends spirally about an axis, that extends in an axial direction from a support, and that has a free end face facing away from the support,
wherein the free end face has a recess that extends in a longitudinal direction of the wall, wherein the recess is laterally bounded by at least one inner wall that is formed at a section of the wall that is associated with the free end face and that extends substantially in parallel with the axial direction, the inner wall being inclined such that the inner wall converges in the direction of the free end face so that the recess narrows or becomes narrower in a direction of an opening of the recess
inserting a seal into the recess such that the seal is movably arranged in the recess, the seal having a trapezoidal cross-section, and
at least sectionally plastically bending over the section of the wall so that the inner wall extends at least sectionally obliquely to the axial direction.

* * * * *